US005833215A

United States Patent [19]

Vandenburg

[11] Patent Number: 5,833,215

[45] Date of Patent: Nov. 10, 1998

[54] COMBINATION METAL AND WOOD POST REMOVING DEVICE

[76] Inventor: Arlow Vandenburg, 1237 96th St. SE., Hague, N. Dak. 58542

[21] Appl. No.: 916,459

[22] Filed: Aug. 22, 1997

[51] Int. Cl.[6] ..... E21B 19/00

[52] U.S. Cl. ..... 254/30

[58] Field of Search ..... 254/30, 31, 131, 254/132, 133, DIG. 1, 29 R

[56] References Cited

U.S. PATENT DOCUMENTS

| | | | |
|---|---|---|---|
| 762,846 | 6/1904 | Rotvold | 254/132 |
| 1,709,683 | 4/1929 | Pollock | 254/132 |
| 2,226,456 | 12/1940 | Westendorf | 254/132 |
| 3,867,733 | 2/1975 | Verlander | 254/132 |
| 5,499,795 | 3/1996 | Mathews | 254/30 |

*Primary Examiner*—Robert C. Watson
*Attorney, Agent, or Firm*—Michael S. Neustel

[57] ABSTRACT

A combination metal and wood post removing device for allowing the user to remove from the ground metal and wooden posts. The inventive device includes a base, a vertical support member attached to the base, a handle pivotally attached to the support member opposite of the base, an engaging head having a slot and a notch attached to an end of the handle, and a pair of chains attached to a distal end of the engaging head for engaging a wooden post.

5 Claims, 4 Drawing Sheets

COMBINATION METAL AND WOOD POST REMOVING DEVICE

BACKGROUND OF THE INVENTION

1. Field of the Invention

The present invention relates generally to post pulling devices and more specifically it relates to a combination metal and wood post removing device for allowing the user to remove from the ground metal and wooden posts without accidental slipping of the post from the removing device.

2. Description of the Prior Art

There are numerous post pulling devices. For example, U.S. Pat. No. 5,499,795 to Mathews; U.S. Pat. No. 2,777,726 to Lundgren et al; U.S. Pat. No. 5,022,632 to Beideck; U.S. Pat. No. 4,726,565 to Keller; U.S. Pat. No. 4,161,310 to Parker; U.S. Pat. No. 4,040,601 to Boardman; U.S. Pat. No. 4,738,433 to Hoff; U.S. Pat. No. 5,368,277 to Moss; U.S. Pat. No. 5,100,104 to Wagner; U.S. Pat. No. 298,794 to Allen all are illustrative of such prior art.

Mathews (U.S. Pat. No. 5,499,795) discloses a post pulling device with a vertical support member attached to a base plate and an elongated telescoping handle connected to a reinforced C-shaped head portion for removing metal posts.

Lundgren et al (U.S. Pat. No. 2,777,726) discloses a post pulling device comprising a syncline shaped frame and a handle pivotally attached to a point of the frame and having an adjustable C-shaped head for removing metal posts.

Beideck (U.S. Pat. No. 5,022,632) discloses a post pulling device for pulling various types of posts by utilizing different interchangeable working heads for the desired post to be pulled.

While these devices may be suitable for the particular purpose to which they address, they are not as suitable for allowing the user to remove from the ground metal and wooden posts. The prior art merely teaches a post pulling device for pulling metal posts. Beideck discloses a post pulling device which can pull metal and wooden posts, but requires the interchanging of various types of heads to do so. Further, the prior art does not teach an engaging head which prevents a metal post from slipping.

In these respects, the combination metal and wood post removing device according to the present invention substantially departs from the conventional concepts and designs of the prior art, and in so doing provides an apparatus primarily developed for the purpose of allowing the user to remove from the ground metal and wooden posts.

SUMMARY OF THE INVENTION

A primary object of the present invention is to provide a combination metal and wood post removing device that will overcome the shortcomings of the prior art devices.

Another object is to provide a combination metal and wood post removing device that removes both metal and wooden posts without requiring the user to interchange engaging heads.

An additional object is to provide a combination metal and wood post removing device that reduces the chance of a metal post accidentally slipping out from the engaging head during pulling of the metal post.

A further object is to provide a combination metal and wood post removing device that is lightweight.

Another object is to provide a combination metal and wood post removing device that is manipulated only by physical force by the user.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
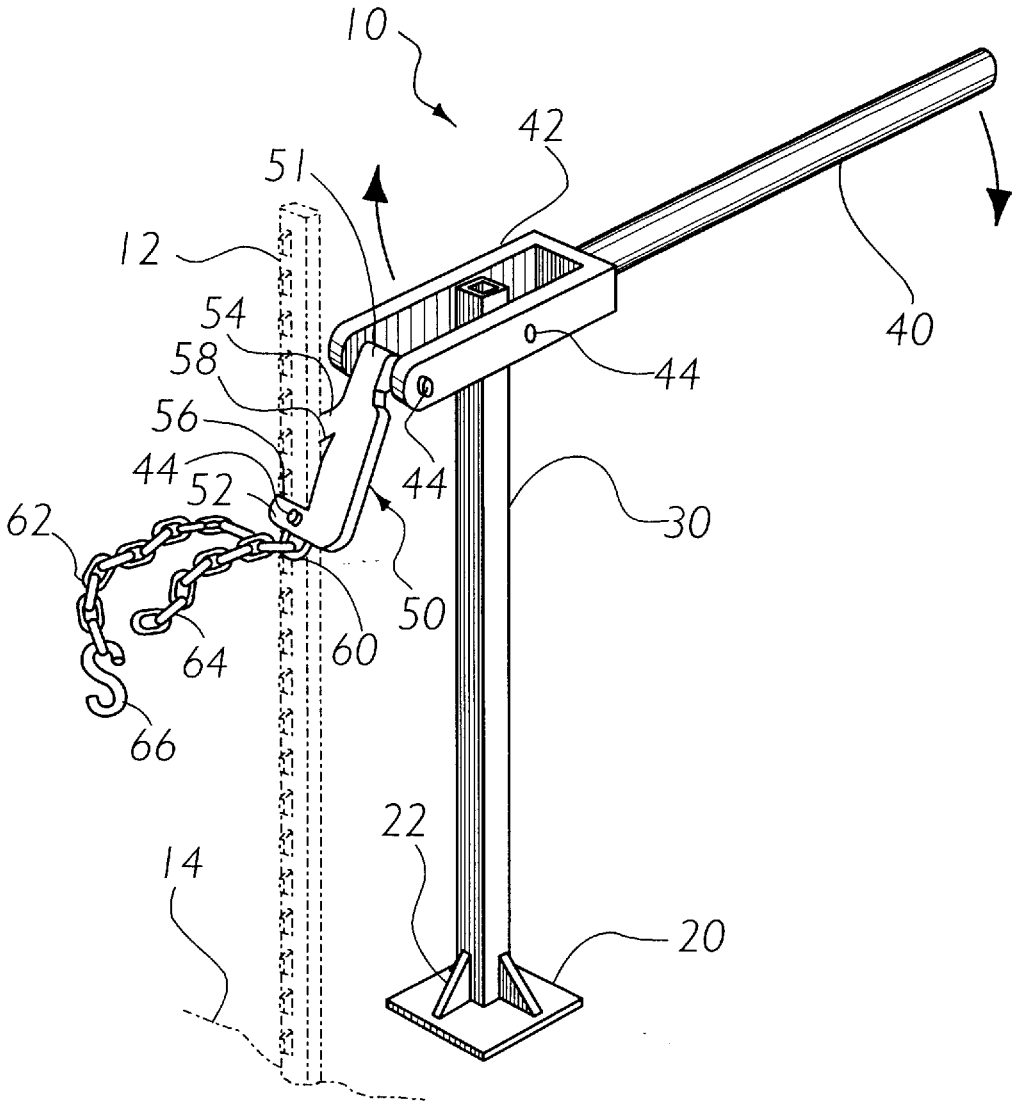
FIG. 1 is an upper perspective view of the present invention engaging a metal post.

Turning now descriptively to the drawings, in which similar reference characters denote similar elements throughout the several view, FIGS. 1 through 4 illustrate a combination metal and wood post removing device 10, which comprises a base 20, a vertical support member 30 attached to the base 20, a handle 40 pivotally attached to the support member opposite of the base 20, an engaging head 50 having a slot 56 and a notch 58 attached to an end of the handle 40, and a pair of chains attached to a distal end of the engaging head 50 for engaging a wooden post 16.

Figure 2:
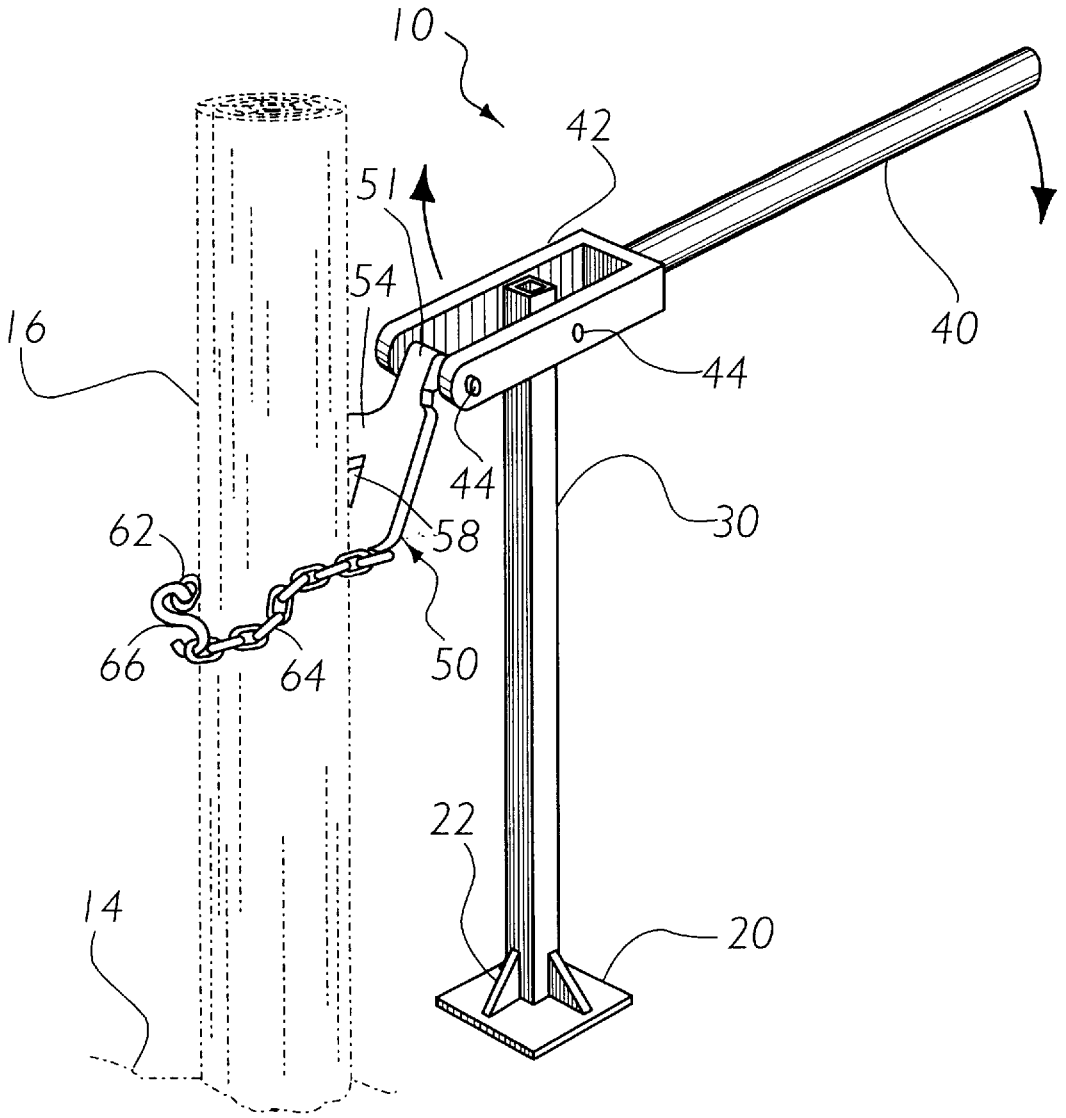
FIG. 2 is an upper perspective view of the present invention engaging a wooden post.
Figure 4:
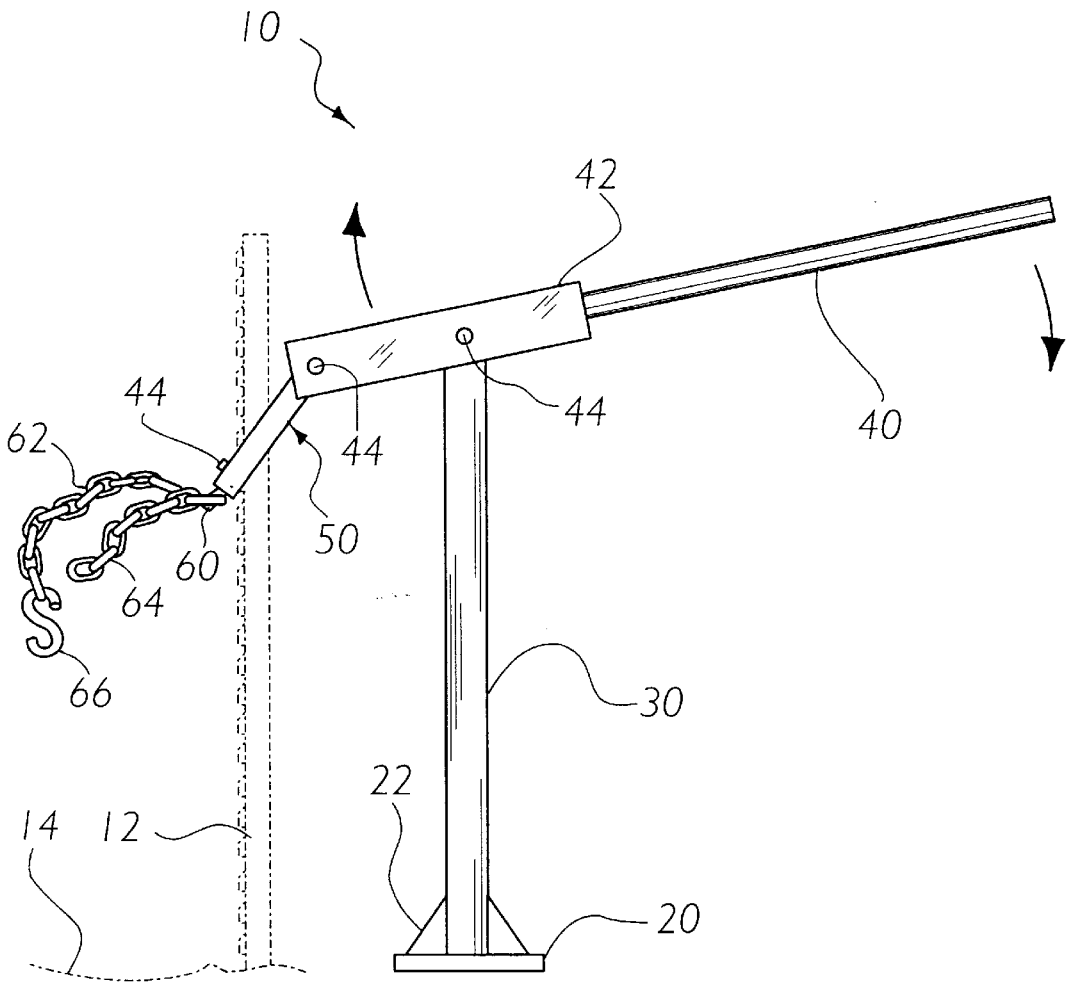
FIG. 4 is a side view of the present invention.

As best shown in FIGS. 1 and 2 of the drawings, the base 20 is preferably constructed from a swaged material. The vertical support member 30 having a lower portion and an upper portion is attached substantially orthogonally to the base 20 as best shown in FIG. 4 of the drawings. A plurality of reinforcing members 22 are attached between the lower portion of the vertical support member 30 and a top surface of the base 20 for reinforcing the joint.

As shown in FIGS. 1 through 4 of the drawings, the handle 40 has a first end and a second end. The second end includes a U-shaped member 42 having an open end attached thereto. The U-shaped member 42 is pivotally attached about the upper portion of the vertical support member 30 as best shown in FIGS. 1 and 2 of the drawings. The U-shaped member 42 pivots about a substantially horizontal axis as shown in FIG. 4 of the drawings.

Figure 3:
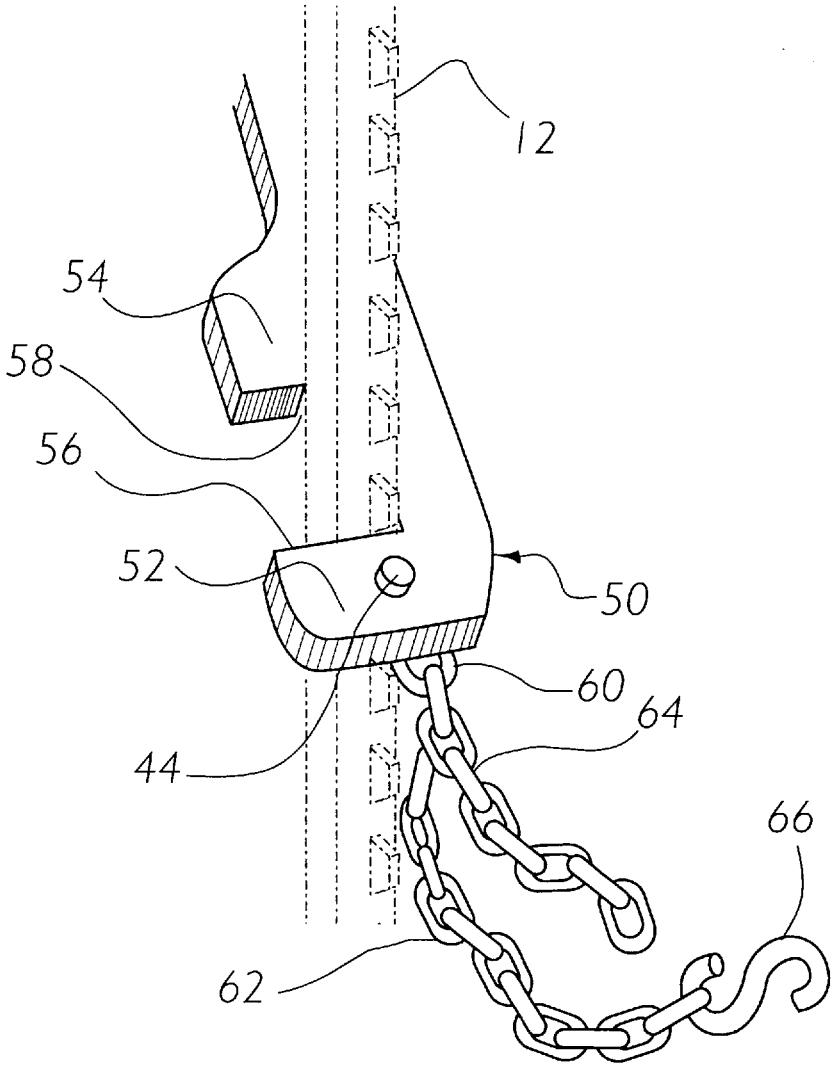
FIG. 3 is a magnified upper rear view of the engaging head.

As best shown in FIGS. 1 and 2, a tube member 51 is rotatably attached by a fastener 44 within the open end of the U-shaped member 42. The engaging head 50 has a front portion 52 and a rear portion 54. The rear portion 54 is attached to the tube member 51. The engaging head 50 includes a slot 56 projecting into a side of the engaging head 50 substantially parallel to the rotational axis of the tube member 51. The slot 56 receives the metal post 12 to be pulled from the ground surface 14. The opposing sides of the slot 56 surround the metal post 12 and engage a nub on the metal post 12 for gripping the metal post 12. The engaging head 50 further includes a notch 58 projecting from the slot 56 into the rear portion 54 as best shown in FIGS. 1 and 3.

The notch 58 receives a traverse portion of a T-shaped metal post 12 for preventing the metal post 12 from accidentally being removed from the slot 56 during the elevating of the metal post 12.

As best shown in FIG. 2 of the drawings, a loop 60 is secured to the front portion 52 of the engaging head 50 by a fastener 44. A first chain 62 and a second chain 64 are attached to the loop 60 as shown in FIGS. 1 and 2. A hook 66 is secured to the first chain 62 opposite of the engaging head 50. The first chain 62 and the second chain 64 are positionable around a wooden post 16 or other cylindrical post with the hook 66 removably engaging the second chain 64 as shown in FIG. 2 of the drawings. The fastener 44 removably projects slightly into the wooden post 16 for gripping the wooden post 16 during the upward movements. The fastener 44 can be constructed so as to have a pointed end to engage a portion of the wooden post 16.

In use, for removing a metal post 12 from the ground surface 14, the engaging head 50 is manipulated so that the slot 56 receives the metal post 12 near a lower portion of the metal post 12 as shown in FIG. 1. Thereafter, the handle 40 is manually manipulated downwardly so as to force the engaging head 50 upwardly upon the metal post 12. The front portion 52 adjacent the slot 56 engages the nub on the metal post 12 and the rear portion 54 of the engaging head 50 moves upward and toward the metal post 12 until the notch 58 has fully received the traverse portion of the metal post 12 so as to prevent an accidental removal of the metal post 12 from the slot 56. As the handle 40 is further manipulated downward, the engaging head 50 forces the metal post 12 upwardly. If the metal post 12 is not completely pulled from within the ground, the handle 40 is then raised to allow the engaging head 50 to reposition itself about the metal post 12. The above procedure is thereafter repeated until the metal post 12 is completely removed from the ground.

For removing a wooden post 16, a front edge of the engaging head 50 is juxtaposed to a lower portion of the wooden post 16 as shown in FIG. 2 of the drawings. The first chain 62 is manipulated around the wooden post 16 until the hook 66 is snugly engaged with the second chain 64 as shown in FIG. 2 of the drawings. Thereafter, the handle 40 is manually manipulated downwardly so as to force the engaging head 50 upwardly upon the wooden post 16. As the handle 40 is further manipulated downward, the engaging head 50 forces the fastener 44 into the wooden post 16 and forces the wooden post 16 upwardly. If the wooden post 16 is not completely pulled from within the ground, the handle 40 is then raised to allow the pair of chains 62, 64 to be repositioned about the lower portion of the wooden post 16. The above procedure is thereafter repeated until the wooden post 16 is completely removed from the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination metal and wood post removing device comprising:

a base;

at least one vertical support member having a lower end and an upper end, said lower end attached to said base orthogonally;

a handle pivotally attached to said vertical support member near said upper end, wherein said handle has a first end and a second end;

an engaging head having a front portion and a rear portion, said rear portion pivotally attached to said second end of said handle;

a slot projecting into a side of said engaging head for engaging said metal post; and at least one chain attached to said front portion for surrounding and gripping said wooden post.

2. The combination metal and wood post removing device of claim 1, wherein said engaging head further includes a notch projecting from said slot into said rear portion for receiving a traverse portion of said metal post for preventing accidental removal of said metal post during elevating of said metal post.

3. The combination metal and wood post removing device of claim 2, wherein said at least one chain comprises a first chain and a second chain attached to said front portion of said engaging head, wherein a hook is secured to a distal end of said first chain for removably engaging said second chain.

4. The combination metal and wood post removing device of claim 3, wherein said base includes a plurality of reinforcing members attached to said vertical support member for preventing movement of said vertical support member with respect to said base.

5. The combination metal and wood post removing device of claim 2, wherein said notch is syncline shaped.

* * * * *